United States Patent [19]

Duzinskas et al.

[11] 4,134,580

[45] Jan. 16, 1979

[54] METHOD AND APPARATUS FOR HOPPER LOADER

[75] Inventors: Donald R. Duzinskas, Western Springs; Anthony Chomenko, Chicago, both of Ill.

[73] Assignee: W. F. Hall Printing Company, Chicago, Ill.

[21] Appl. No.: 774,870

[22] Filed: Mar. 7, 1977

[51] Int. Cl.[2] ..... B65H 5/22

[52] U.S. Cl. ..... 271/6; 271/7; 271/35; 271/195; 271/199; 271/221; 271/225; 271/265

[58] Field of Search ..... 271/3.1, 6, 7, 35, 195, 271/198, 199, 225, 221, 222, 265, 275, 276, 3

[56] References Cited

U.S. PATENT DOCUMENTS

| | | | |
|---|---|---|---|
| 1,831,245 | 11/1931 | Hitchcock | 271/225 UX |
| 3,522,943 | 8/1970 | Swanson | 271/35 X |
| 3,612,511 | 10/1971 | Godlewski | 271/3.1 X |
| 3,624,807 | 11/1971 | Schwebel | 271/195 X |
| 3,841,622 | 10/1974 | Swanson | 271/225 X |
| 3,870,294 | 3/1975 | Donner | 271/3.1 |
| 3,904,191 | 9/1975 | Maier | 271/3.1 X |

*Primary Examiner*—Richard A. Schacher
*Attorney, Agent, or Firm*—Emrich, Root, O'Keefe & Lee

[57] ABSTRACT

Folded signatures of lightweight stock are fed in a direction parallel to the backbone of the signatures and deposited in sets of predetermined number and in shingled relation onto a main conveyor moving transverse to the direction of feed from the supply stack. The main conveyor deposits the signatures on the top of a stack in the hopper of a gathering machine. The height of the stack in the hopper is sensed, and this is used to control feeding from the supply stack. Preferably, the supply stack is held in a hopper with the signatures resting on a second or supply conveyor which extends upwardly and outwardly from the main conveyor so that adjacent loading machines can be nested to reduce space requirements.

9 Claims, 6 Drawing Figures

METHOD AND APPARATUS FOR HOPPER LOADER

BACKGROUND AND SUMMARY

The present invention relates to apparatus for feeding signatures to the hopper of a large gathering machine of the type which is used in binderies, for example, gather folded signatures in the assembly of a magazine.

Gathering machines for use in binderies are well known, and they are arranged to have a number of stations, each provided with a hopper holding a number of signatures. The gathering machine takes one signature off the bottom of each hopper in sequence and assembles them into a magazine, book or catalog. It is desirable to maintain the height of signatures in each hopper within predetermined limits so that the weight of the signatures in a stack is generally fixed, and the amount of force necessary to remove a signature from the bottom of a stack is substantially constant. There is thus a reduced likelihood of jamming in the gather machine during the removal of signatures from a hopper.

Machines are known for supplying signatures to a hopper while maintaining the height of signatures in the hopper within predetermined limits. Normally, such machines provide a first or source stack at a location removed from the hopper of the gathering machine and some conveyor mechanism for feeding signatures from the source stack to the hopper of the gathering machine. The advantage of these machines is that a worker can load large quantities of signature into the source stack. Even though the total weight of the source stack may vary substantially, nevertheless, the height and weight of the hopper stack is controlled. This enables a single worker to tend a number of machines.

Such machines have been found advantageous for use in feeding signatures of heavy stock, but there usefulness does not extend to feeding signatures of lightweight stock such as are used in catalogs, for example. In feeding lightweight signatures of this type there is a tendency to buckle the signature, thereby complicating the problem of feeding from the bottom of the source stack, which, it will be recalled, may vary widely in height and weight. The present invention overcomes this problem and is capable of reliably feeding lightweight signatures from a source stack to the hopper of a gathering machine. This is accomplished mainly by feeding the signatures from the bottom of the source stack in a direction which is parallel to the backbone of the signature onto a main conveyor which feeds the signatures in shingled relation to the gathering machine hopper. By feeding the signatures from the source stack in the direction parallel to the backbone of the signatures, the signature backbone is used as a stiffener rib to prevent buckling. Because the main conveyor is operated continuously, and the signatures are fed onto the main conveyor in a direction transverse to the movement of the top flight of the conveyor, the signatures are automatically deposited in desired shingled relation on the conveyor.

A light source and photo cell combination is used to control the feeding of signatures from the source stack onto the main conveyor, and a second conveyor is used to feed the signatures from beneath the source stack. An inclined guide plate is used to direct the signatures from the source stack onto the main conveyor, and other features are incorporated to overcome the problems encountered in feeding lightweight signatures.

The present invention has, moreover, still another advantage. Due to the fact that the signatures are fed from the source stack in a transverse direction relative to the movement of the main conveyor, the hopper for the source stack is located to the side of the main conveyor—rather than in line of the main conveyor. According to the present invention, the source stack is arranged at a location elevated above the main conveyor, and the source stack conveyor is inclined upwardly and outwardly from the main conveyor. This not only facilitates feeding of signatures from the source stack onto the main conveyor, but it also permits the source stack to be located above the main conveyor of an adjacent hopper loader. Thus, the hopper loaders nest to reduce space requirements. It will be appreciated that the stations of the gathering machine are located as closely together as possible, so that hopper loaders must be correspondingly close together. In prior art machines which aligned the source stack to feed parallel to the feed direction of the main conveyor, the overall loader extended outwardly a considerable distance from the hopper of the gathering machine, thereby reducing space available for storing large quantities of signatures. Typically, large quantities of signatures are held on wooden pallets in the area immediately adjacent the hopper loader so as to minimize the distance over which a worker must travel to keep a hopper loader filled with signatures. The more space that is available for storing large quantities of signature, the more convenient it is not only to the worker but to the operators of the pallet trucks who must bring the signatures to each individual hopper loader.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figures 1, 4:
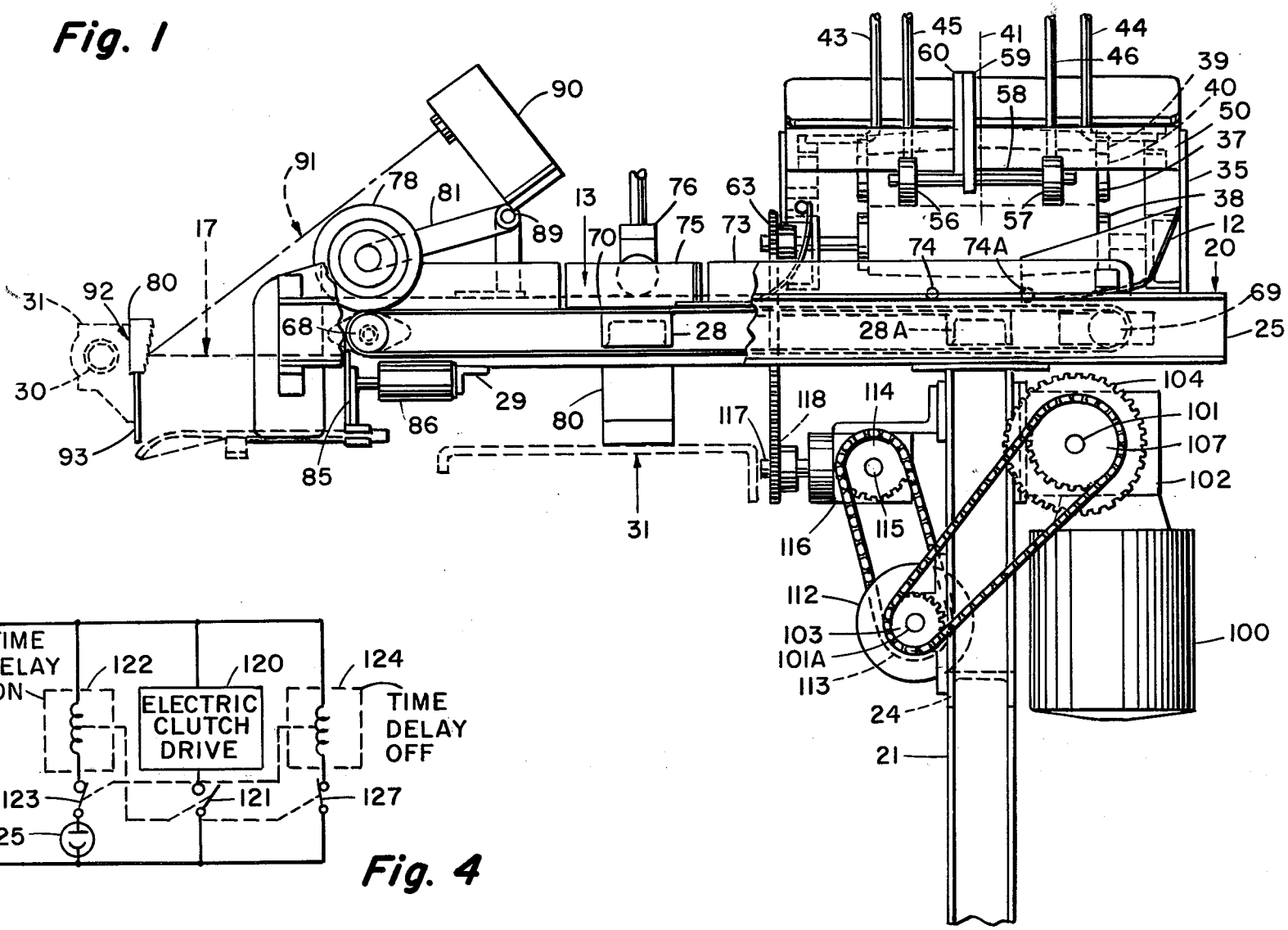
FIG. 1 is a left side view of apparatus constructed according to the present invention.
FIG. 4 is a circuit schematic diagram of the control system for the apparatus of FIG. 1.
Figure 2:
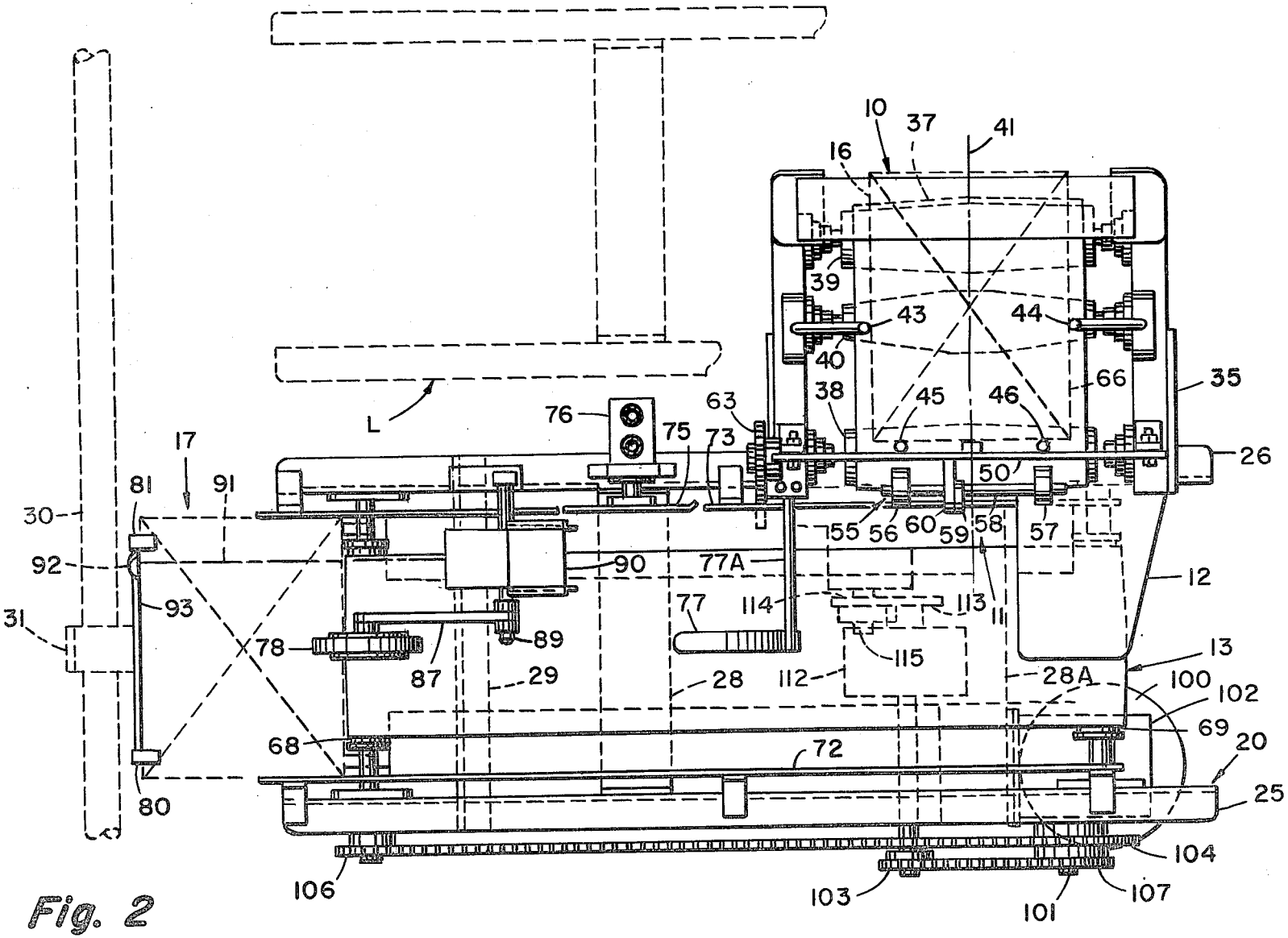
FIG. 2 is a plan view of the apparatus of FIG. 1.
Figure 3:
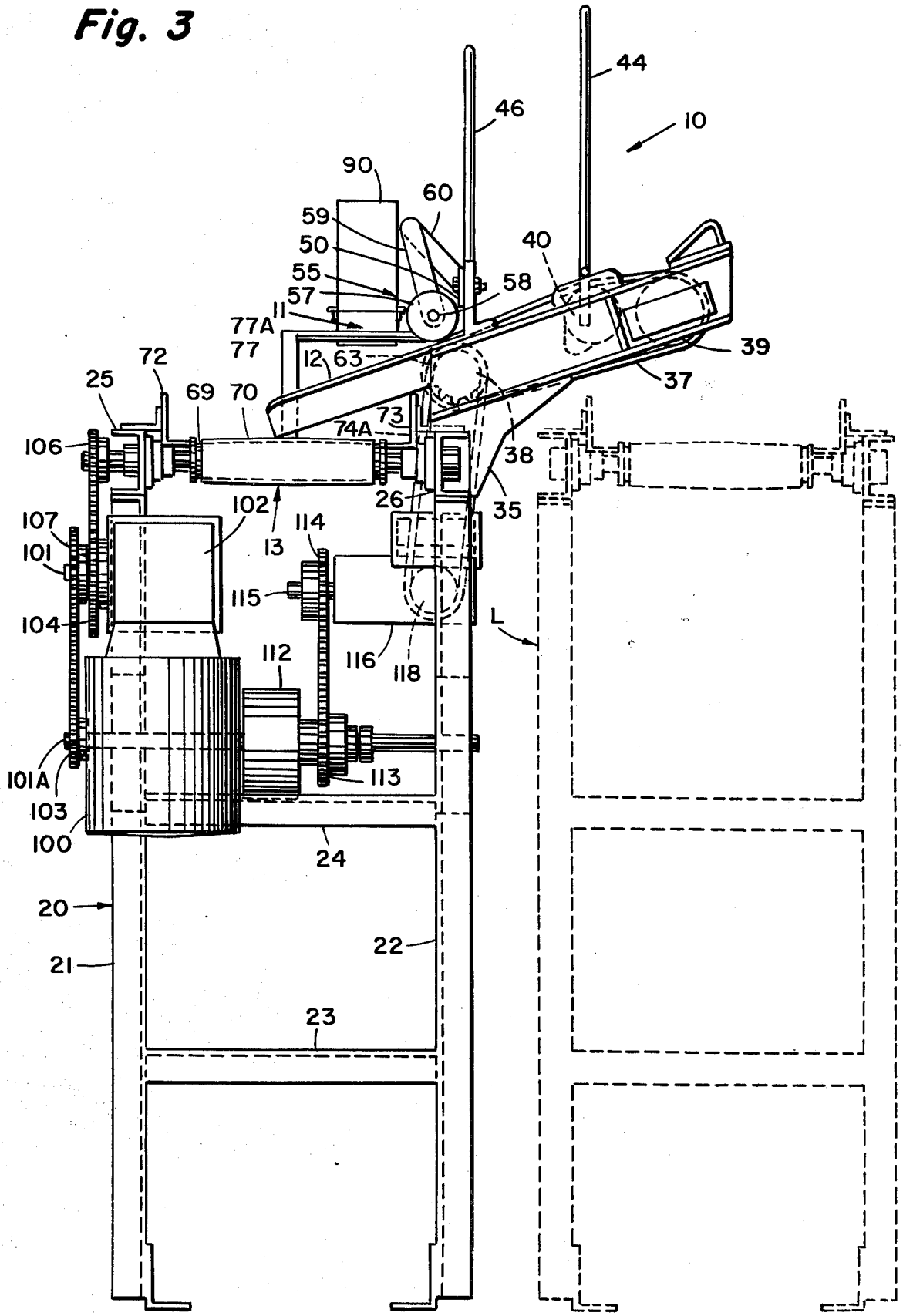
FIG. 3 is a front view of the apparatus of FIG. 1.

Referring first to FIGS. 1–3, reference numeral 10 generally designates a hopper or magazine for a source stack of signatures. Such signatures, as indicated above, may be fourcolor rotogravure printed signatures on lightweight stock.

Before discussing the details of the invention, a general overview will be helpful in understanding the invention. Signatures are fed from the source stack hopper 10 at a downward inclination (see FIG. 3) through a gate or feed mechanism generally designated 11, and they are guided by an inclined plate 12 onto a main conveyor 13 which travels in a direction transverse of the direction of feed from the source stack. As will be further explained below, groups of signatures are placed upon the top of the source stack with their backbones extending along a line designated 16 in FIG. 2 so that the backbone or fold becomes the leading edge when the direction of feed is changed. It will thus be appreciated that the signatures are taken from the bottom of the source stack in a direction parallel to the backbone of the signatures. This advantageously employs the strength of the backbone and uses it as a stiffener element in maintaining the signatures in a flat position during initial feed from the bottom of the source stack. Once the signatures are deposited on the main conveyor, in shingled relation, they remain flat; and there is no problem in feeding them such as are encountered in feeding the signatures from the bottom of the source stack. It will be appreciated that the lower signature bears all the weight of the other signatures in the source stack, and this weight makes it difficult to feed thin signatures from the bottom of the stack.

The signatures are taken from the source stack in groups or sets of predetermined number. However, this feeding of sets of signature takes place only when the height of stack 17 in the supply hopper of the gathering machine is below a predetermined level. The stack 17 is sometimes referred to as the supply stack.

Referring to FIG. 1, the signatures are deposited at the discharge or left end of the main conveyor 13 onto the top of the supply stack 17 which is held in a hopper of the main gathering machine. The gathering machine, as is conventional, takes the signatures from the bottom of the supply stack 17.

Referring now in greater detail, a main frame is generally designated 20. The main frame 20 includes first and second rear upright leg members 21, 22 which are secured together by cross braces 23, 24. Extending forwardly are horizontal frame members of rails 25, 26, seen best in FIG. 2. The side rails 25, 26 are secured together at an intermediate location by means of a transverse channel frame member 28 (FIG. 1), and at a forward position by another transverse frame member 29 in the form of an angle iron. The discharge end of the frame is held by an upright support 30 which is attached to plate 31 which is a part of the gathering machine.

Referring now particularly to FIGS. 2 and 3, the hopper 10 for the source stack is mounted by means of a subframe casting 35 to the right side rail 26 of the main frame. The feed mechanism for the source stack includes a driven conveyor comprising a continuous belt 37 entrained over first and second end rollers 38, 39 and a double-tapered roller 40 which is located beneath the source stack at the far or upper end. As best seen in FIG. 2, the rollers 38 and 39, as well as the roller 40 have a double taper—that is, they have a maximum cross sectional area at the center, decreasing toward either end. This provides a ridge or crown along a transverse feed center line, represented by the line 41. This has been found to facilitate the picking of signatures from beneath the source stack. Because the signatures are lightweight, they are easily flexed. By providing a ridge or crown in the direction of initial travel, the signatures in the source stack are curved, and this breaks any adhesion between adjacent signatures. Secondly, the crown provides an even lineal engagement with the signatures at the bottom of the stack along the transverse feed direction.

The signatures are held in the hopper for the source stack by a first pair of upright rods 43, 44 at the sides of the stack respectively, and a second pair of rods 45, 46 at the leading edge of the source supply. A transverse bar 50 is secured to the upright rods 45, 46 and it extends across the feed edges of the signatures (which actually forms the bottom of the individual signatures as they are placed in the stack). A solid gate 51 is secured to the back of the bar 50; and it is adjustable vertically to assist in controlling the number of signatures fed from the bottom of the source stack. A pinching roller assembly generally designated 55 controls the feeding of the signatures from the bottom of the source stack. The pinch roller assembly includes first and second casters 56, 57 which are rotatably mounted to a shaft 58 which is connected by a link 59 to a support member 60 which is secured to the transverse bar 50.

The material used for the conveyor belt 37 is a soft, stippled synthetic rubber, commercially available and used in conveyors, possessing a high coefficient of friction with paper, particularly the highly calendared paper used in fourcolor rotogravure signatures.

The forward roller 28 of the feed mechanism for the source stack is driven at the left side in FIG. 2 by a chain and sprocket 63 which is intermittently driven by a motor and clutch arrangement and associated control circuitry, as will be discussed.

As best seen in FIGS. 2 and 3, the guide plate 12 extends outwardly and downwardly beneath the conveyor 37 to partially support the edge 66 of the signatures as they are delivered from the hopper in which the source stack is stored. The guide plate 12 is further inclined downwardly in the direction of travel of the signatures on the main conveyor 13 to effect a smooth delivery of signatures to the main conveyor. Thus, the guide plate 12 partially supports the longitudinal edge of the signatures in the first direction of feed, which edge ultimately will become the trailing edge in the main direction of feed. The function of the guide plate 12 is to partially reduce the friction between the main conveyor and the signatures until the signature being delivered extends fully across the main conveyor. This facilitates depositing the signatures in shingled relation on the main conveyor.

Turning now to the main conveyor, it includes a forward driven roller 68 and a rear roller 69 about which an endless belt 70 is entrained. A pair of upright side rails 72, 73 extend along the main conveyor for guiding the signatures in shingled relation to the stack 17. A pair of ports 74, 75 are formed in the rail 73 beneath the location at which the signatures are delivered from the source stack. Air is forced under pressure through the ports 74, 75, and this blowing has the effect of reducing friction between overlying signatures to facilitate the transfer of motion of the signatures to a transverse direction without causing the signatures to stick to one another. This transition of motion is facilitated by means of the inclined guide plate 12 and the air jets 74, 75.

After the signatures are traveling in the transverse direction in shingled relation, their side edges are jogged in new register by means of a jogger plate 75 which is actuated by a linear actuator 76 operating under compressed air. Just prior to reaching the jogger plate 75, the stream passes beneath a flexible, resilient metal strap 77, suitably mounted by a bar 77A, for holding the stream down to enhance engagement with the main conveyor.

At the discharge end of the main conveyor, a large idler wheel 78 rides over the signatures and maintains their frictional engagement with the conveyor belt 70 until they are ultimately discharged onto the stack 17. At this time, the signatures are traveling at a relatively high speed to insure delivery, and since the paper is glossy and the friction between signatures is low, the inertia of the delivered signatures has a tendency to cause the leading edge to rise in the hopper for the stack 17. In order to prevent this, a pair of toothed stops 80, 81 are located in the hopper for stack 17 at the level at which signatures are delivered from the main conveyor to engage and hold the leading edge of each signature as it is delivered into the hopper. Thus, the signatures lie flat in the supply stack 17.

Located near the bottom of the hopper is a second jogger plate 85 actuated by a linear actuator 86 which reciprocates in the direction of delivery of the signatures to the hopper 17. Thus, the signatures have been jogged in both directions by the time they are taken from the hopper 17 by the gathering machine.

The idler wheel 78 is mounted to a link 87 which, in turn, is pivotally mounted to a transverse stub shaft 89. The shaft 89 also holds a source of light 90 which generates a light beam, schematically indicated by reference numeral 91 which is aimed to impinge upon a photodetector 92 mounted in an end plate 93 of the hopper 17. The source 90 and detector 92 are arranged such that when the height of the stack in the hopper 17 reaches a predetermined lever, the beam 91 is interrupted.

Referring now to FIGS. 1 and 3 in particular, an electric motor 100 drives a horizontal shaft 101 through a right-angle gear 102. The shaft 101 is provided with a first sprocket 104 which is connected through a chain to drive a sprocket 106 (see FIG. 2) connected to the shaft on which the forward roller 68 is mounted for the main conveyor 13.

The shaft 101 of the motor 100 also drives an electric clutch 112, the output shaft of which is provided with a sprocket 113 which drives a second sprocket 114 coupled to a shaft 115. The shaft 115 is connected to a right-angled gear 116 which drives a shaft 117 connected to another sprocket 118. The sprocket 118 is coupled by means of a chain to the previously described sprocket 63 which drives the forward roller 38 of the conveyor delivery system of the source stack.

Turning now to FIG. 4, the electric clutch 112 is schematically represented by the block 120. It is connected in series with a first contact 121 which is normally open and actuated by a relay 122. The coil of relay 122 is connected in series with normally closed contacts 123 of a second relay 124, and the photocell diagrammatically shown at 125. A second set of contacts, normally closed, designated 127 are actuated by the relay 122, and they are connected in series with the coil of relay 124.

The relay 122 is a time delay ON relay (that is, its contacts are not actuated until a preset time after its coil is energized), and relay 124 is a time delay OFF relay (that is, its contacts remain actuated for a preset time after its coil is de-energized). In operation, relay 122 is energized, and after the preset delay time, contacts 121 close to energize the electric clutch drive 120. When the clutch is engaged, the roller 38 is driven to deliver signatures from the bottom of the source stack onto the main conveyor. At the same time that the clutch is actuated, contacts 127 open, thereby de-energizing the coil of relay 124. After the preset delay time for relay 124, the contacts 123 open to de-energize the coil of relay 122. Thus, the delay OFF time of relay 124 determines the portion of each operating cycle during which signatures are fed from the source stack, and the delay ON time of relay 122 determines the remainder of the cycle time. The relays 122, 124 continue to toggle back and forth, feeding signatures in sets during the preset feed time determined by the delay OFF time of relay 124 as long as the photoelectric cell 125 remains closed, indicating that the height of the hopper stack is insufficient to interrupt the light beam 91. The photoelectric cell 125 is a dark-operated cell—that is, when the height of the stack is sufficient to interrupt the light beam, the cell will open.

Referring now to FIGS. 2 and 3, it will be observed that the delivery mechanism for the source stack 10 is inclined upwardly and outwardly from the input section of the main conveyor, and this permits an adjacent loader partially shown and designated L, to have its main conveyor section nested beneath the source stack 10. This is deemed to be a significant advantage in that it conserves the amount of space adjacent the gathering machine which must be occupied by the hopper loaders, thereby allowing additional available space for storing pallets of folded signatures.

Figure 5:
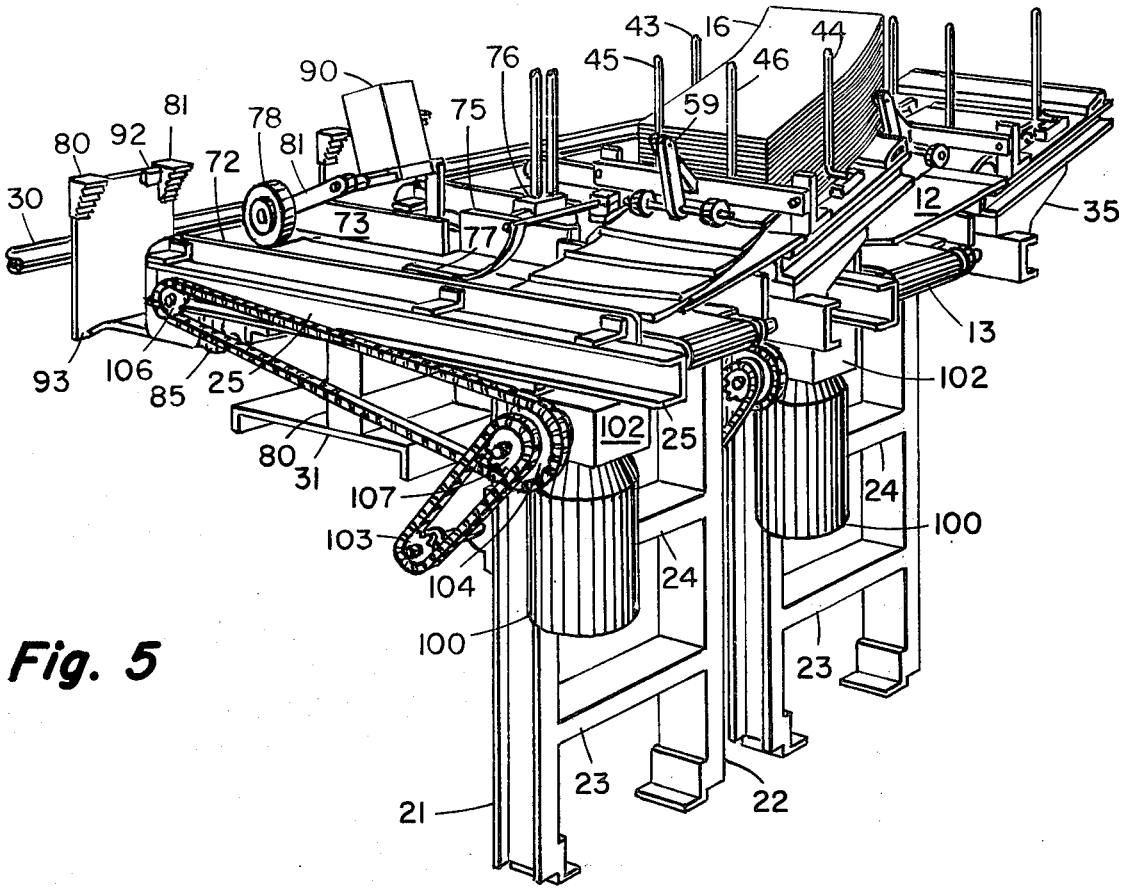
FIGS. 5 and 6 are upper perspective views, taken from the left front side of the apparatus of FIG. 1 showing the feeding of signatures.
Figure 6:
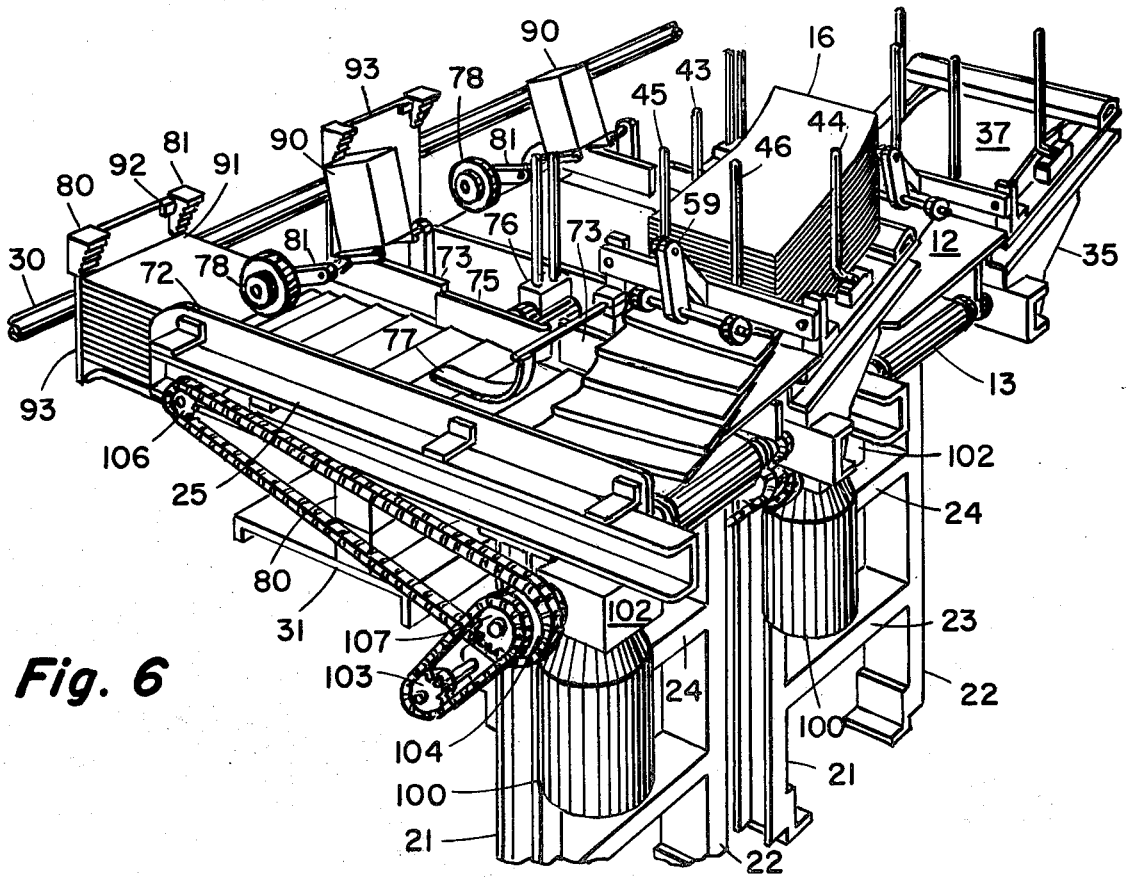

Referring now to FIGS. 5 and 6, it will be observed that the signatures are delivered in shingled relation along a first direction parallel to the backbone of the signatures as they are stored in the source stack. The signatures, in shingled relation, are delivered to an input section of the main conveyor, the belt of which moves in a second direction transverse of the first direction so that the backbone of the signatures becomes the leading edge on the main conveyor. This delivery from a source stack to the main conveyor is such that the shingled relation is maintained even though the direction of movement of the individual signatures changes 90 degrees. The trailing edges of the signatures are assisted onto the second conveyor by the inclined plate 12 until the full length of a signature extends across the main conveyor. This prevents a tendency of the main conveyor to move the signatures prematurely into the second direction. The air jets beneath the source stack further prevent signatures from sticking to each other during the direction change.

The signatures are jogged so that their top and bottom edges are aligned while traveling along the main conveyor, and they are then delivered to the top of the supply stack, the delivery motion being limited by the toothed stops 80, 81. While in the supply stack, the signatures are again jogged in a direction parallel to the backbone so that all of the edges are aligned in the hopper stack prior to being picked by the gathering machine.

As long as the height of the supply stack is less than a predetermined height as determined by the location of the light beam and photoelectric sensor, the signatures will be delivered from the source stack in sets, the number in the sets being substantially the same for each set.

Having thus described in detail a preferred embodiment of the invention, persons skilled in the art will be able to modify certain of the structure which has been illustrated and substitute equivalent elements for those disclosed while continuing to practice the principle of the invention; and it is, therefore, intended that all such modifications and substitutions be covered as they are embraced within the spirit and scope of the appended claims.

We claim:

1. In apparatus for delivering signatures folded to form a backbone from a source stack to a supply stack, the improvement comprising: main conveyor means having an input section and a discharge end for moving signatures deposited at said input section along a first direction and for delivering said signatures to the top of said supply stack through said discharge end; means for moving said signatures from the bottom of said source stack in shingled relation along a second direction parallel to the backbone of said signatures and transverse to said first direction; and fixed support means for supporting said signatures as they are moved from beneath said source stack to a location above said main conveyor and for guiding said signatures while in continuously superposed relation onto said main conveyor, said support means including a plate positioned to receive signatures from said source stack and to support the trailing edge of said signatures above said main conveyor means until said signatures are completely extended over said main conveyor means, thereby to reduce the tendency of signatures being delivered from said source stack to enter the main conveyor stream before they are fully positioned over said main conveyor.

2. The apparatus of claim 1 further comprising means for holding said signatures to form said source stack, said means for moving said signatures comprising a second conveyor having an endless belt inclined upwardly and outwardly of said main conveyor means, whereby the main conveyor means of an adjacent apparatus may be nested beneath said source stack holding means.

3. The apparatus of claim 2 further comprising a plurality of rollers in said conveyor having a cross section of reduced area from the center toward each end thereof, thereby to define a ridge in the belt of said second conveyor parallel to said second direction of movement of said signatures.

4. The apparatus of claim 1 further comprising means for sensing that the height of said hopper stack is less than a predetermined height, and drive means for actuating said moving means to deliver signatures from said source stack for a predetermined time when said sensing means indicates that the height of said hopper stack is less than said predetermined height.

5. The apparatus of claim 1 further comprising air jet means adjacent said input section of said main conveyor means for aerating signatures being fed from said source stack while said signatures are being delivered onto said main conveyor means.

6. The apparatus of claim 5 further comprising pinch roller means for engaging the top of the shingled stream of signatures being delivered from said source stack.

7. The apparatus of claim 6 further comprising vertical gate means adjacent the leading edge of signatures in said source stack for controlling the depth of shingled signatures being fed to said pinch roller means.

8. The apparatus of claim 1 further comprising a flexible resilient strap above said shingled stream on said main conveyor means and bearing down on the signatures traveling in said first direction.

9. The apparatus of claim 1 further comprising jogger plate means adjacent the discharge end of said main conveyor means for jogging the signatures thereon in a direction parallel to said backbone prior to delivery to said supply stack.

* * * * *